US008375608B2

(12) United States Patent
Thomas et al.

(10) Patent No.: US 8,375,608 B2
(45) Date of Patent: Feb. 19, 2013

(54) PINNABLE PRESSABLE SURFACE SYSTEM

(75) Inventors: Janna Lee Thomas, Loveland, CO (US); Paul Roger Thomas, Loveland, CO (US)

(73) Assignee: USAUS, LLC, Loveland, CO (US)

( * ) Notice: Subject to any disclaimer, the term of this patent is extended or adjusted under 35 U.S.C. 154(b) by 466 days.

(21) Appl. No.: 12/583,115

(22) Filed: Aug. 13, 2009

(65) Prior Publication Data

US 2011/0035975 A1 Feb. 17, 2011

(51) Int. Cl.
*D06F 83/00* (2006.01)
*D06F 81/00* (2006.01)

(52) U.S. Cl. ..... 38/66; 38/137

(58) Field of Classification Search ..... 38/103–140, 38/DIG. 1, DIG. 2, DIG. 3, 66; 108/115, 108/118
See application file for complete search history.

(56) References Cited

U.S. PATENT DOCUMENTS

| | | | | | |
|---|---|---|---|---|---|
| 1,420,027 | A | | 6/1922 | Ehrman et al. | |
| 1,634,619 | A | | 7/1927 | Lake | |
| 2,539,714 | A | * | 1/1951 | Young et al. | 38/66 |
| 2,711,601 | A | | 6/1955 | Lehrman | |
| 2,807,895 | A | * | 10/1957 | Hicks | 38/66 |
| 2,814,135 | A | * | 11/1957 | Freeman | 38/66 |
| 2,999,325 | A | | 9/1961 | Munson et al. | |
| 3,425,143 | A | * | 2/1969 | Feld et al. | 38/102.9 |
| 3,463,488 | A | | 8/1969 | Milu | |
| 3,579,877 | A | * | 5/1971 | Bray, Jr. | 38/12 |
| 3,733,724 | A | | 5/1973 | Davis | |
| 4,030,200 | A | | 6/1977 | Francis | |
| 4,064,814 | A | | 12/1977 | Pokorny et al. | |
| 4,335,533 | A | * | 6/1982 | Kroenke | 38/141 |
| 4,557,062 | A | | 12/1985 | Mattesky | |
| 4,616,434 | A | | 10/1986 | Riba et al. | |
| 4,621,003 | A | | 11/1986 | O'Kane | |
| 4,813,166 | A | | 3/1989 | Drake | |
| 4,822,015 | A | | 4/1989 | Glasman et al. | |
| 4,832,323 | A | | 5/1989 | Principe et al. | |
| 4,982,516 | A | | 1/1991 | Cervantes | |
| 4,990,399 | A | * | 2/1991 | Hoopengardner | 428/317.3 |
| 5,020,405 | A | | 6/1991 | Wolfson et al. | |
| 5,027,989 | A | | 7/1991 | Nevius | |
| 5,063,800 | A | | 11/1991 | Jung et al. | |
| 5,090,669 | A | | 2/1992 | Pieroni | |
| 5,102,288 | A | | 4/1992 | Kawasaka | |
| 5,231,777 | A | | 8/1993 | Mattesky et al. | |
| 5,335,432 | A | * | 8/1994 | Simpson | 38/106 |
| 5,371,961 | A | | 12/1994 | Mattesky | |
| 5,392,543 | A | | 2/1995 | Lehrman | |
| 5,408,940 | A | | 4/1995 | Winchell | |
| 5,894,690 | A | | 4/1999 | Lehrman | |
| 6,058,853 | A | | 5/2000 | Pinch | |
| 6,233,854 | B1 | | 5/2001 | Levy et al. | |
| 6,327,800 | B1 | * | 12/2001 | Daams | 38/137 |

(Continued)

FOREIGN PATENT DOCUMENTS

| | | | |
|---|---|---|---|
| WO | WO9508277 | * | 4/1995 |

*Primary Examiner* — Ismael Izaguirre
(74) *Attorney, Agent, or Firm* — Craig R. Miles; CR Miles, P.C.

(57) ABSTRACT

Generally, the present invention relates to an ironing surface for use in ironing ironable materials, and in particular relates to a pinnable pressable ironing surface on which ironable materials can be pinned and pressed with a hot iron.

22 Claims, 5 Drawing Sheets

U.S. PATENT DOCUMENTS 6,763,621 B1 7/2004 Felsenthal et al.
6,793,991 B2 * 9/2004 Thuma et al. ..... 428/34.1
6,796,059 B2 9/2004 Denisart et al.
7,040,048 B2 5/2006 Delery et al.
7,131,223 B2 * 11/2006 Krotts et al. ..... 38/140
7,223,177 B2 5/2007 Tarbell
2002/0095827 A1 * 7/2002 Rosa ..... 38/137
2004/0219347 A1 * 11/2004 Eichler ..... 428/292.7
2006/0117810 A1 * 6/2006 Kendall et al. ..... 68/3 R
2010/0095565 A1 * 4/2010 Ma et al. ..... 38/103

* cited by examiner

PINNABLE PRESSABLE SURFACE SYSTEM

I. BACKGROUND

Generally, the present invention relates to an ironing surface for use in ironing materials. Specifically, a pinnable pressable ironing surface on which materials can be pinned and pressed with an iron.

Conventional ironing surfaces provide a flat heat resistant surface. Garments to be ironed can be placed on the flat heat resistant surface. The garment can be further urged against the flat heat resistant surface using a hot iron to further flatten the garment. However, conventional ironing surfaces and conventional methods of ironing suffer from substantial unresolved problems.

A substantial unresolved problem with conventional ironing surfaces can be that the ironing surface has configuration which does not provide a flat heat resistant surface of sufficiently large dimension on which a sufficiently large portion of an ironable material can be placed to be ironed.

Another substantial unresolved problem with conventional ironing surfaces can be that the ironing surface does not provide an ironing surface on which ironable materials can be pinnably fixed prior to being urged against the ironing surface with a hot iron to be further flattened. As to certain ironable materials, the configuration or shape can be impractical to locate in fixed relation to the ironing surface. For example, thin ribbons of ironable material may be difficult to fix against the ironing surface. As to other ironable materials, establishing the ironable material in fixed relation to the ironing surface prior to be urged against the ironing surface with a hot iron may be necessary to avoid deformation of the ironable material in the flattened condition. For example, the shape of perforations of lace materials can be deformed during while ironed if not prior fixed in relation to the ironing surface.

Another substantial problem with conventional ironing surfaces may be that conventional ironing surfaces do not function to allow one or more pins to be passed within or through the ironing surface to establish the longitudinal axis of the one or more pins in fixed relation to the ironing surface. Conventional ironing surfaces into which a pin can pass into or through may allow the longitudinal axis of the pin to travel, swivel, wobble, release in relation to the ironing surface upon application of forces substantially similar to those transferred to an ironable material during ironing.

The inventive pinnable pressable ironing surface and inventive methods of using the pinnable pressable ironing surface address each of the foregoing problems associated with conventional ironing surfaces and methods of ironing ironable materials.

II. SUMMARY OF THE INVENTION

Accordingly, a broad object of the invention can be to provide a pinnable pressable ironing surface which allows ironable materials to be located in pinnably fixed relation with an ironing surface prior to be being urged against the ironing surface with a hot iron to flatten the ironable material.

A second broad object of the invention can be to provide a method of ironing in which ironable materials can be pinned to a pinnable pressable ironing surface to fix the configuration of the ironable material in relation to the pinnable pressable surface prior to being urged with a hot iron against the pinnable pressable material to further flatten the ironable material.

A third broad object of the invention can be to provide a pinnable surface which provides a substantially planar pinnable material having a first side and a second side separated by a thickness in the range of about 0.3 inch and about 1 inch which engages a perforated material of a support panel to allow one or more pins to be passed within or through the thickness of the material to establish the longitudinal axis of the one or more pins in substantially fixed relation to the pinnable material.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Generally, the present invention relates to an ironing surface for use in ironing ironable materials. Specifically, a pinnable pressable ironing surface on which materials can be pinned and pressed with a hot iron.

Figure 1:
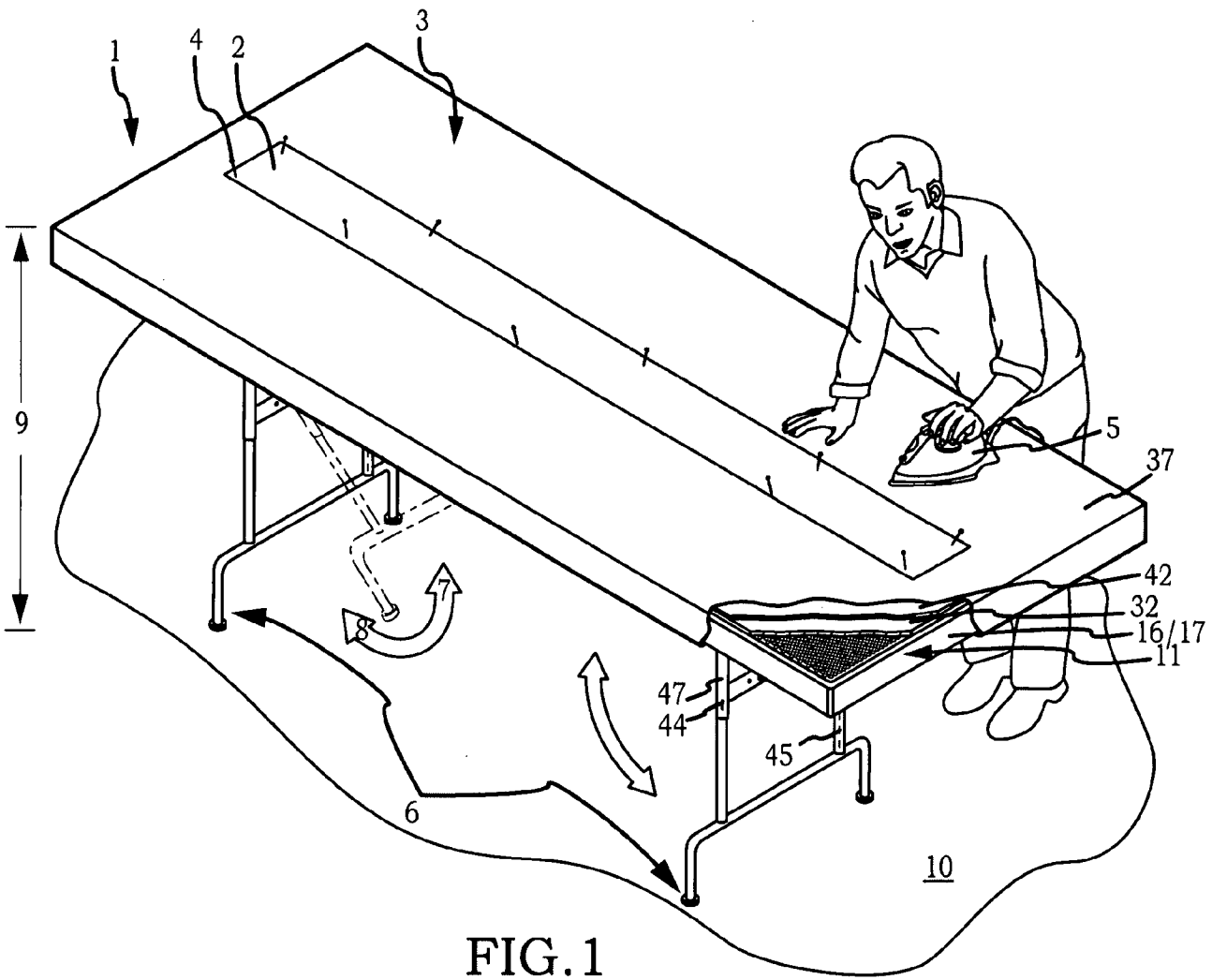
FIG. 1 shows a particular method of ironing an ironable material using a particular embodiment of the inventive ironing surface.

Now referring primarily to FIG. 1, a method of using a pinnable pressable ironing surface (1) is shown. In one step, the inventive method can include locating an ironable material (2) on the pinnable pressable ironing surface (1). The term "pinnable pressable ironing surface" means embodiments of the inventive ironing surface which in part includes a pinnable surface (3), as further described herein below. For the purposes of this invention, the term "ironable material" includes any material which can be urged with a sufficiently hot iron (5) against an ironing surface to further flatten the material [affix](also referred to as "ironing") and includes as non-limiting examples: cotton material, wool material, silk material, velvet material, felt material, batting material (all fiber content and all fusible and sew-in varieties), pre-quilted cotton material, fusible tape material (both decorative and functional), lace material, fusible fabric sheet material, fusible vinyl material, fabric and thread applique material, fusible, dissolvable, melt away and tear away threads and or stabilizer materials, freezer paper material, fusible web material, hot iron transfer materials (both transfer pens and transfers on paper) and laser-cut fusible backed materials, and the like.

In another step, the inventive method can further include pinning the ironable material to the pinnable surface (3). For the purposes of this invention, the term "pinning" or "pinned" means passing one or more pins (4) through an ironable material (2) a sufficient distance into a pinnable pressable ironing surface (1) to fix the location of the ironable material (2) in relation to the pinnable surface (3) of the pinnable pressable ironing surface (1) for ironing.

In another step, the inventive method can further include ironing the ironable material (2) pinned in fixed relation to the pinnable surface (3) of the pinnable pressable ironing surface (1). For purposes of this invention, the term "ironing" means ironable materials (2) urged with a hot iron (5) against the pinnable surface (3) of the pinnable pressable ironing surface (1) to further flatten the ironable material (2). For the purposes of this invention the term "hot iron" means an iron having sufficient temperature when urged against an ironable material (2) located on the pinnable surface (3) of the pinnable pressable ironing surface (1) to cause flattening of the ironable material (2).

In another step, the inventive method can further include removing the pins (4) from the pinnable pressable ironing surface (1) and the ironable material (2).

In another step, the inventive method can further include rotating a pair legs (6) from the closed condition (7) (typically rotated to locate adjacent the underside of the pinnable pressable surface ironing surface (1)) to the open condition (8) (typically rotated to extend outwardly from the underside of the pinnable pressable ironing surface (1)) to support the pinnable pressable ironing surface (1) at a height (9) above a support surface (10). For the purposes of this invention the term "height" means a distance between the top of the pinnable pressable ironing surface (1) and a support surface (10) useful in ironing an ironable material (2). For the purposes of this invention the term "support surface" means any surface capable of engaging the pair of legs (6) coupled to particular embodiments of the pinnable pressable ironing surface (1) described herein to establish the pinnable pressable ironing surface (1) at a height (9) useful in ironing an ironable material (2) and includes the following non-limiting examples: a ground surface, a floor surface, a table surface, a cabinet surface, or the like.

Figure 2:
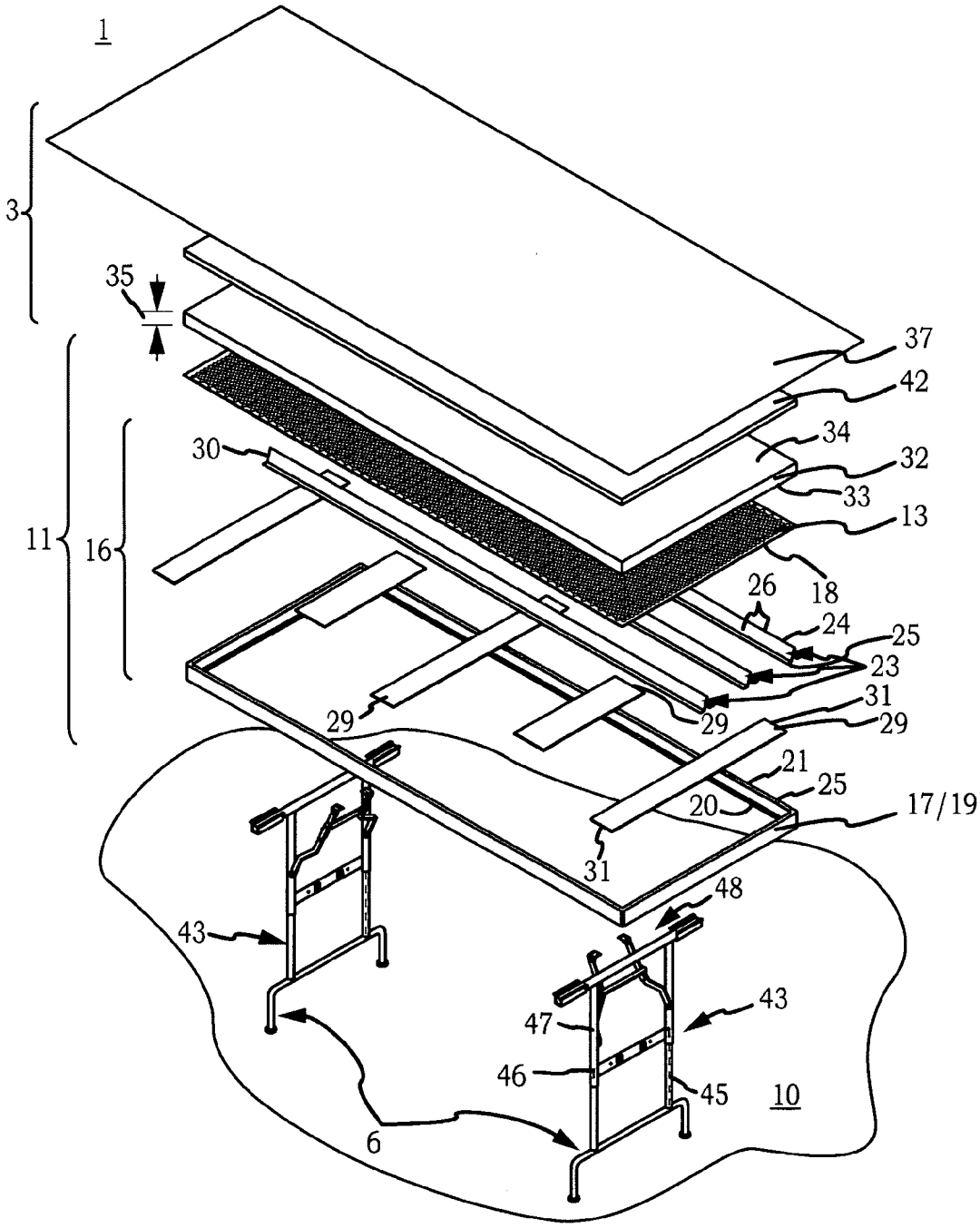
FIG. 2 is an exploded view of a particular embodiment of the inventive ironing surface.
Figure 3:
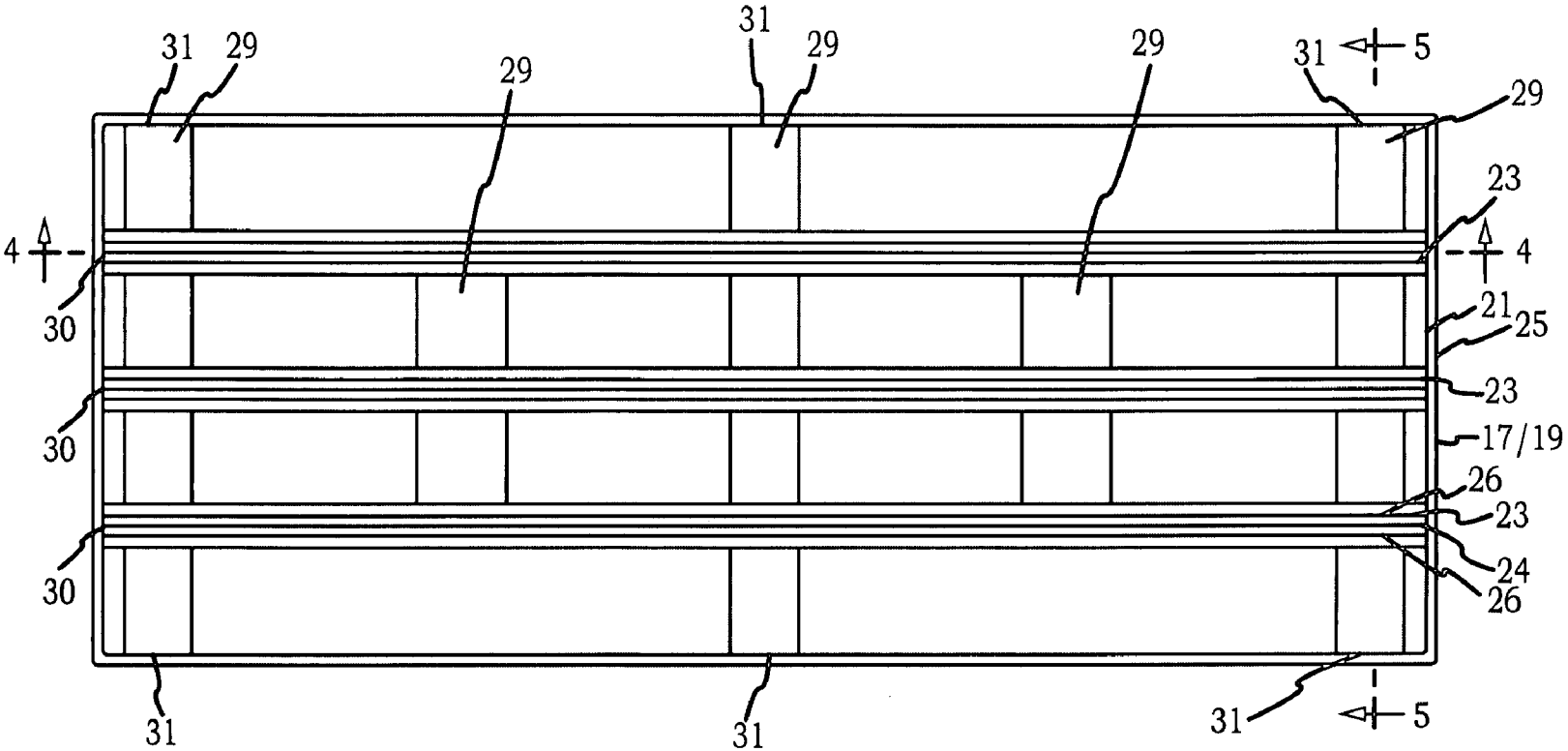
FIG. 3 is plan view of a support panel of a particular embodiment of the inventive ironing surface shown in FIG. 2.

Now referring primarily to FIG. 2, a particular non-limiting embodiment of a pinnable pressable ironing surface (1) is shown in exploded view which includes a support panel (11) which can function to support a pinnable pressable surface (3). The embodiment of the pinnable pressable ironing surface (1) as shown in FIG. 2 can further include a pair legs (6) coupled to the support panel (11) which further engage a support surface (10) to establish the pinnable pressable surface (3) at a height (9) above the support surface (10).

Now referring primarily to FIGS. 2-6, embodiments of the support panel (11) can include a perforated material (13). The perforated material (13) can take the form of a substantially flat sheet or a sheet having a plurality of perforations (14)(see also FIG. 6) supportable in a substantially planar configuration. The perforated material (13) can be made from a numerous and wide variety of metals, plastics, or other materials sufficiently heat resistant to support the pinnable pressable surface (3) on which ironable materials (2) are ironed. The perforated material (13) can have an amount of open area (15) in the range of about 50 percent ("%") to about 80% (the total cumulative open area of the perforations (14) divided by the total area of the perforated material (13)×100). As one non-limiting example, the perforated material (13) can be a perforated sheet metal having a plurality of hexagonal perforations adjacently staggered having a thickness of about 20 gauge to about 24 gauge. The hexagonal perforations can have opposed sides of each hexagon located a distance apart in the range of about 0.2 inch and about 0.3 inches. Particular embodiments of the perforated material (13) can have a thickness of about 22 gauge with hexagonal perforations of 0.25 inch with the centers staggered at about 0.2850 inch. In this configuration of the perforated material (13) can have an open area of about 77%. However, these non-limiting examples are not intended to preclude the use of other types of perforated materials (13) having perforations (14) which may be circular, ovoid, square, octagonal or the like which may provide a lesser or greater amount of open area (15).

Figure 4:
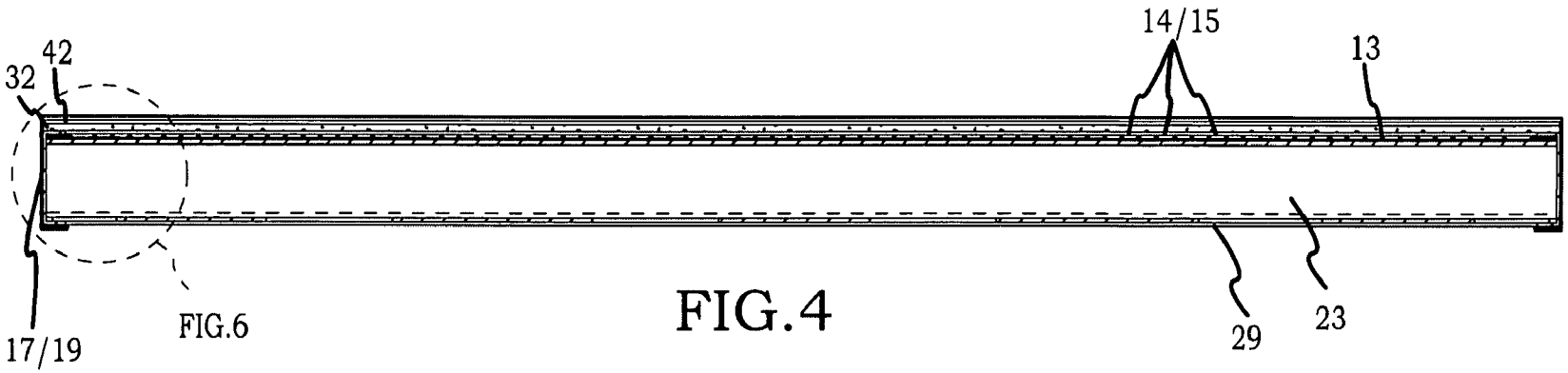
FIG. 4 is a cross section view 4-4 of the support panel shown in FIG. 3.
Figure 5:
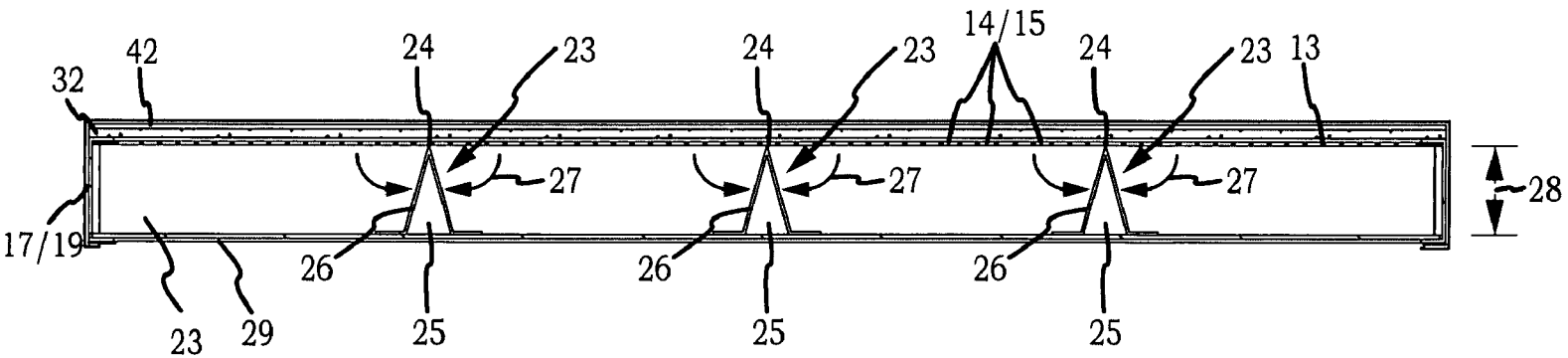
FIG. 5 is a cross section view 5-5 of the support panel shown in FIG. 4.
Figure 6:
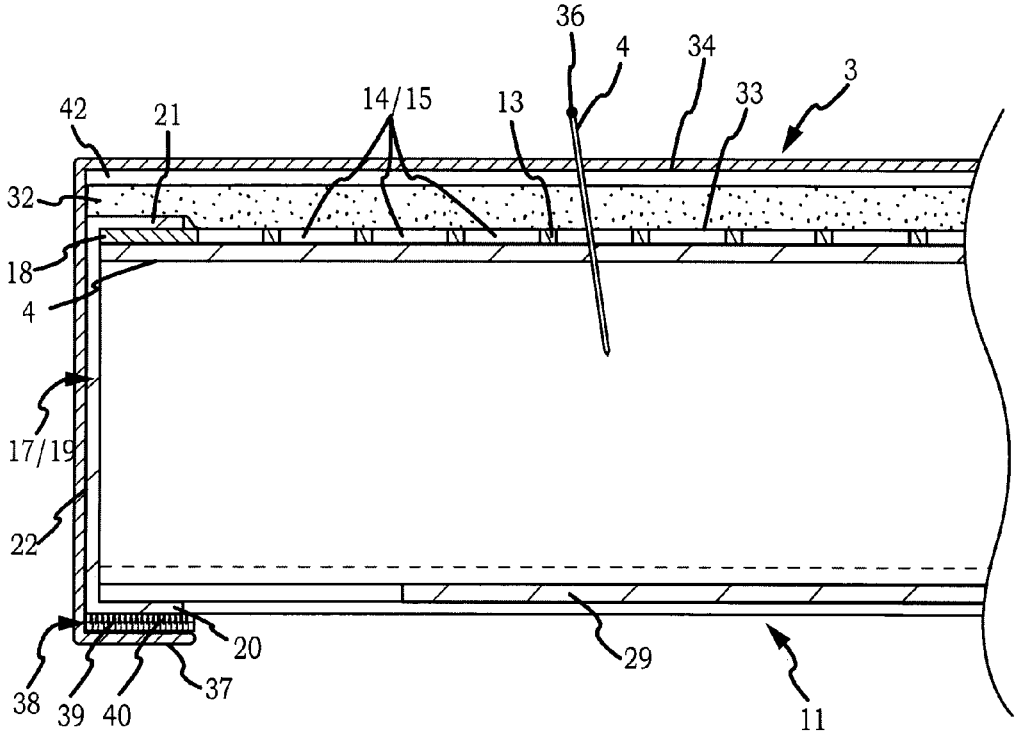
FIG. 6 is an enlarged view of a part of the support panel shown in FIG. 4.

Again referring primarily to FIGS. 2-6, the support panel (11) can further include a support structure (16) which engages the perforated material (13) to maintain a substantially planar configuration. For the purposes of this invention, the term "substantially planar configuration" means sufficiently flat to support the pinnable surface (3) further described below for the intended purpose of ironing ironable material (2). It is understood that the degree of flatness may vary across the perforated material (13) depending on the particular support structure (16) used to support the perforated material (13) and the method of securing the perforated material (13) within the support structure (16). Particular embodiments of the support panel (11) can provide the support structure (16) in the form of a frame (17) to which a portion of the periphery (18) of the perforated material (13) couples to generate the substantially planar configuration. As one non-limiting example, the frame (17) can be produced from lengths of metal channel (19). The metal channel (19) in cross section (see for example FIG. 6) having a pair of sides (20)(21) held a distance apart by a base (22). As one non-limiting example, the metal channel (19) can provide a base (22) having width in the range of about 1 inch to about 2 inches. With each of the pair of sides (20)(21) perpendicularly coupled to opposed edges of the base (22) in substantially opposed parallel relation to the other. The pair of sides (20)(21) can extend outwardly a distance in the range of about 0.25 inch to about 0.75 inch. The embodiment of the frame (17) shown in FIGS. 2-6 provides a metal channel (19) having a thickness of about 22 gauge with the base (22) having a width of about one and one half inches with each of the pair of sides (20)(21) extending outward a distance of about one-half inch. Each of the pair of sides (20)(21) of the metal channel (19) can have an internal surface and an external surface. As shown in FIG. 6, a particular embodiment of the support structure (16) provides a rectangular frame (17) having length of about sixty inches and a width of about 24 inches to which a piece of metal perforated material (13) of corresponding dimension couples by portions of the periphery (18) of the perforated material (13).

The support panel (11) can further include a plurality of triangular support members (23) each having an apex (24) and a base (25). The apex (24) of each of the plurality of triangular support members (23) can be located in the support structure (16) to engage the surface of the perforated material (13) to support the perforated material (13) in the substantially planar configuration, as above described. The base (25) of the plurality of triangular support members (23) may be closed or may be open as shown for example in FIG. 2. By engaging the apex (24) of each of the plurality of triangular support members (23) with the perforated material (13), the open area (15) of perforated material (13) can remain substantially unchanged as the apex (24) of each of the plurality of triangular support members (23) does not have a substantial area to close the open area (15) of the perforated material (13). While the sides (26) of the particular embodiment of the plurality of triangular support members (23) shown in the Figures form an angle (27)(see for example FIG. 5) of about 30°, the invention is not so limited and the angle (27) formed by the sides (26) of the plurality of triangular members (23) can be any angle (27) between about 20° and about 45°. The height of the triangular support member (28) can be greater or lesser depending upon location of the particular one of the plurality of triangular support members (23) within the support structure (16).

Each of the plurality of triangular support members (23) can fixedly located within the support structure (16) by coupling the corresponding ends (30) of each of the plurality of triangular support members (23) to support structure (16). As shown in FIG. 5, the base (22) of each of the plurality triangular support member (23) can engage the internal surface of one of the extending sides of the frame (17) made from the metal channel (19). As to particular embodiments of the support panel (11) the apex (24) of each of the plurality of triangular support members (23) can also be fixedly coupled to the perforated material (13). As a non-limiting example, spot welds can be periodically established between the perforated material (13) and the apex (23) of each of the plurality triangular support members (23) (one particular embodiments provides spot welds at twelve inch centers). The plurality of triangular support members (23) can traverse the length or the width of the frame (17). While the embodiment of the support structure (16) shown in FIG. 2, provides a plurality of triangular support members (23) which traverse the length of a frame (17) to provide a support structure (16); the invention is not so limited and the support structure (16) can take any constructional form capable of supporting the perforated material (13) in a substantially planar configuration.

Embodiments of the support structure (16) can further provide a plurality of stiffener elements (29) which can be located within the support panel (11) in substantially perpendicular relation to the direction in which the plurality of triangular support elements (23) traverse the support structure (16). As one example, the plurality of stiffener elements (29) can be produced from 16 gauge sheet metal having sufficient length to allow opposed stiffener ends (31) to couple to opposed sides of the support structure (16)(or frame (16) depending on the embodiment) and sufficient width to provide structural support to the plurality of triangular support members (23) sufficient to maintain the substantially planar configuration of the perforated material (13) during use of the pinnable pressable ironing surface (1) for its intended purpose or normal use.

Now referring primarily to FIGS. 2, 4 and 6, embodiments of the invention can further provide a pinnable pressable surface (12). The pinnable pressable surface (3) can include a pinnable material (32) having a first side (33) and a second side (34) separated by a pinnable thickness (35) in the range of about 0.3 inches and about 0.6 inches. The first side (33) of the pinnable material (32) can be engaged with said perforated material (13) of said support panel (11) to provide a substantially planar pinnable material (32). The term "pinnable material" for the purposes of this invention means a material which will allow a pin (4) to pass within and release from the thickness of the material by normal manual forcible urging of the hand but when the pin (4) has passed within the thickness of the material the orientation of the longitudinal axis (36) of the pin (4) (see for example FIG. 6) can be substantially fixed in relation to the pinnable pressable ironing surface (1) during ironing of a pinned ironable material (2), as above described A non-limiting example of a pinnable material (32) can be a S.A.E. F-1 pressed wool felt having a thickness in the range of about three eighths inch and about 1 inch. A particular embodiment of the pinnable material (32) can be a S.A.E. F-1 pressed wool having a thickness of about one half inch (for example 0.481 inch to 0.519 inch) and about 7.60 pounds to about 8.40 pounds per square yard available from Southeastern Felt & Supply Corporation, 2870 Armentrout Drive, Concord, N.C. 28026.

The pinnable surface (3) can further include an ironable cover (37) which covers at least the pinnable material (32) (or the pinnable material and additional layers of material) engaged with the perforated material (13). As shown by FIGS. 1 and 6 the ironable cover (37) can wrap about the support panel (11) having the pinnable material (32) engaged with the perforated material (13). The ironable cover (37) can be produced from any fabric which can be engaged with an iron (5) sufficiently hot for ironing an ironable material (2). One non-limiting embodiment of a material from which the ironable cover (37) can be made is 100% cotton fabric. A one example, a Kona Premium Muslin having a weight of about 4.02 ounces per square yard available from Robert Kaufman, 129 West 132$^{nd}$ Street, Los Angeles, Calif. 90061 (Product Code K053-1529) can be utilized in embodiments of the invention; however, the invention is not so limited.

Now referring primarily to FIG. 6, a particular embodiment of the ironable cover (37) further includes a mechanical fastener (38) which allows the ironable cover (37) to secure to a part of the support panel (11). Securement of the ironable cover (37) can draw the surface of the ironable cover (37) taut against the surface of the pinnable material (32). One non-limiting example of a mechanical faster (38) can be matable surfaces of a hook material (39) and a loop material (40) such as VELCRO. As to those embodiments of the ironable cover (37) having a hook material (39) (or loop material (40)) coupled at the cover periphery (41), the corresponding loop material (39)(or hook material (39)) can be coupled to the support structure (16).

Again referring primarily to FIGS. 2 and 6, as to certain embodiments, the pinnable surface can further include a resiliently compressible layer (42) locatable between the pinnable material (32) and the ironable cover (37). A non-limiting example of a resiliently compressible layer can be a foam material having a thickness of about 0.2 and about 0.3 inches and based on the ASTM D3574-91 testing protocol have a density of between about 0.75 per cubic foot and about 1.5 pounds per cubic foot, a tensile strength of about 10 pounds per square inch, an elongation percent of about 125%, a tear resistance of about 1.25 pounds per linear inch, and a compression set maximum percent at 50% deflection of about 10%, and a indentation force deflection of about 50 pounds to about 60 pounds per 50 square inches at 25% deflection. One particular example of the resiliently flexible layer (42) can be a 0.25 inch unbacked foam having which falls within the above-described ranges for the ASTM D3574-91 testing protocol. The resiliently compressible layer (42) located between the ironable cover (37) and the pinnable material (32) can act as a barrier to the transfer of liquid to the pinnable material (32) and sufficiently compresses during ironing of an ironable material (2) to make sufficiently uniform the pressure on the ironable material (2) such that irregularities in the pinnable material (32) do not transfer to the ironable material (2) during ironing.

Now referring primarily to FIGS. 1 and 2, certain embodiments of the pinnable pressable ironing surface (1) can further include a pair of legs (6) coupled to the support panel (11). The pair of legs (6) can further engage a support surface (10) to allow the pinnable pressable ironing surface (1) to be established at a height (9) above the support surface (10). Certain embodiments of the pair of legs (6) will include one or more a telescoping element(s) (43) which allow each of the pair of legs to be height adjusted to allow ironing of an ironable material (2) pinned to the pinnable pressable ironing surface (1) by a person whether seated or standing. Each of the telescoping elements (43) can further include a catch element (44) such as a spring loaded bullet catch which recesses and extends in relation to the inner telescoping member (45) to mate with corresponding latch element (46) of the outer telescoping member (47) to fix the inner telescoping member (45) in relation to the outer telescoping member (47). Each of the pair of legs (6) can further provide a collapse element (48) which allows each of the pair of legs (6) to operate between the open condition (8) and the closed condition (9), as above described.

As can be easily understood from the foregoing, the basic concepts of the present invention including the best mode may be embodied in a variety of ways. The invention involves numerous and varied embodiments of an ironing surface including embodiments which further provide a pinnable pressable ironing surface and methods of making and using such ironing surface and pinnable pressable ironing surface.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pinnable material" should be understood to encompass disclosure of the act of "pinning a material"—whether explicitly discussed or not—and, conversely, were there effectively disclosure of the act of "pinning a material", such a disclosure should be understood to encompass disclosure of a "pinnable material" and even a "means for pinning a material." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the ironing surfaces or pinnable pressable ironing surfaces disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A pinnable pressable ironing surface, comprising:

a) a support panel comprising:

i) a perforated material; and ii) a support structure including at least one angular support member having an apex element engaging said perforated material in a substantially planar configuration; and b) a pinnable surface comprising:

i) a substantially planar pinnable material having a first side and a second side separated by a thickness in the range of about 0.3 inches and about 0.6 inches said first side engaged with said perforated material of said support panel; and ii) an ironable cover which engages said substantially planar pinnable material.

2. A pinnable pressable ironing surface as described in claim 1, wherein said substantially planar pinnable material having a first side and a second side separated by a thickness in the range of about 0.3 inches and about 0.6 inches comprises a pinnable material having a thickness in the range of about 0.3 inches and about 0.6 inches having a mass in the range of about 7.0 pounds per square yard and about 9.0 pounds per square yard.

3. A pinnable pressable ironing surface as described in claim 2, wherein said perforated material of said support panel comprises a perforated metal material having a plurality of perforations configured to provide an amount of open space in said perforated metal material in the range of about 70 percent and about 90 percent.

4. A pinnable pressable ironing surface as described in claim 3, wherein said plurality of perforations configured to provide an amount of open space in said perforated metal material in the range of about 70 percent and about 90 percent further comprises a plurality of hexagonal perforations in the range of about 0.20 inches and about 0.30 inches on staggered centers.

5. A pinnable pressable ironing surface as described in claim 4, wherein said support structure coupled to said perforated material further comprises a frame coupled about a periphery of said perforated metal material.

6. A pinnable pressable ironing surface as described in claim 5, where said support structure further comprises at least one stiffener element having a pair of ends coupled to a corresponding pair of sides of said frame, said stiffener element having a stiffener surface coupled to a base of said at least one angular support member.

7. A pinnable pressable ironing surface as described in claim 6, further comprising a pair of leg elements coupled to said support panel said pair of leg elements engagable with a support surface to allow said pinnable surface to be established at a height above said support surface.

8. A pinnable pressable ironing surface as described in claim 7, wherein said leg elements further provide a collapse element to allow said leg elements to travel between a folded condition and an unfolded condition.

9. A pinnable pressable ironing surface as described in claim 8, wherein said leg elements further provide a height adjustment element to adjustably locate said pinnable surface at said height above said support surface.

10. A pinnable pressable ironing surface as described in claim 9, wherein each of said leg elements further provides a leveling element adjustable to level said pinnable surface in relation to said support surface.

11. A method of pinnable pressable ironing, comprising the steps of:

a) obtaining a substantially planar pinnable material having a first side and a second side separated by a thickness in the range of about 0.3 inches and about 0.6 inches having an ironable cover which engages said substantially planar pinnable material; and b) supporting said pinnable surface with a support panel comprising:

i) a perforated material; and ii) a support structure including at least one angular support member having an apex element engaging said perforated material in a substantially planar configuration;

c) pinning a flexible material to said planar pinnable material through said ironable cover; and d) ironing said flexible material pinned to said pinnable surface.

12. A method of pinnable pressable ironing as described in claim 11, wherein said step of pinning a flexible material to a pinnable surface further comprises the step of passing a portion of at least one pin through said flexible material and said substantially planar pinnable surface and a perforation in said perforated material a distance sufficient to secure said flexible material to said pinnable surface for ironing.

13. A method of producing a pinnable pressable ironing surface, comprising the steps of:

a) providing a support panel comprising:

i) a perforated material; and ii) a support structure including at least one angular support member having an apex element engaging said perforated material in a substantially planar configuration; and b) providing a pinnable surface comprising:

i) a substantially planar pinnable material having a first side and a second side separated by a thickness in the range of about 0.3 inches and about 0.6 inches said first side engaged with said perforated material of said support panel; and ii) an ironable cover which engages said substantially planar pinnable material.

14. A method of producing a pinnable pressable ironing surface as described in claim 13, wherein said substantially planar pinnable material having a first side and a second side separated by a thickness in the range of about 0.3 inches and about 0.6 inches said first side engaged with said perforated material of said support panel comprises a pressed wool felt having a thickness in the range of about 0.3 inches and about 0.6 inches having a mass in the range of about 7.0 pounds per square yard and about 9.0 pounds per square yard.

15. A method of producing a pinnable pressable ironing surface as described in claim 14, wherein said perforated material of said support panel comprises a perforated metal material having a plurality of perforations configured to provide an amount of open space in said perforated metal material in the range of about 70 percent and about 90 percent.

16. A method of producing a pinnable pressable ironing surface as described in claim 15, wherein said plurality of perforations configured to provide an amount of open space in said perforated metal material in the range of about 70 percent and about 90 percent further comprise a plurality of hexagonal perforations in the range of about 0.20 inches and about 0.30 inches on staggered centers.

17. A method of producing a pinnable pressable ironing surface as described in claim 16, wherein said support structure coupled to said perforated material further comprises a frame coupled about a periphery of said perforated metal material.

18. A method of producing a pinnable pressable ironing surface as described in claim 17, where said support structure further comprises at least one stiffener element having a pair of ends each coupled to a corresponding pair of sides of said frame and a stiffener surface coupled to a base of said at least one angular support member.

19. A method of producing a pinnable pressable ironing surface as described in claim 18, further comprising a pair of leg elements coupled to said support panel said pair of leg elements engagable with a support surface to locate said pinnable surface at a height above said support surface.

20. A method of producing a pinnable pressable ironing surface as described in claim 19, wherein said pair of leg elements further provide a collapse element to allow said leg elements to travel between a folded condition and an unfolded condition.

21. A method of producing a pinnable pressable ironing surface as described in claim 20, wherein said leg elements further provide a height adjustment element to adjustably locate said pinnable surface at said height above said support surface.

22. A method of producing a pinnable pressable ironing surface as described in claim 21, wherein each of said leg elements further provides a leveling element adjustable to level said pinnable surface in relation to said support surface.

* * * * *